US007011152B2

(12) United States Patent
Soelvik

(10) Patent No.: US 7,011,152 B2
(45) Date of Patent: Mar. 14, 2006

(54) INTEGRATED SUBSEA POWER PACK FOR DRILLING AND PRODUCTION

(75) Inventor: Nils-Arne Soelvik, Houston, TX (US)

(73) Assignee: Vetco Aibel AS, Billingstad (NO)

( * ) Notice: Subject to any disclaimer, the term of this patent is extended or adjusted under 35 U.S.C. 154(b) by 0 days.

(21) Appl. No.: 10/360,375

(22) Filed: Feb. 7, 2003

(65) Prior Publication Data

US 2003/0153468 A1 Aug. 14, 2003

Related U.S. Application Data

(60) Provisional application No. 60/356,024, filed on Feb. 11, 2002.

(51) Int. Cl.
*E21B 43/01* (2006.01)
*E21B 7/12* (2006.01)

(52) U.S. Cl. ..... 166/65.1; 166/357; 166/358; 166/352; 175/7

(58) Field of Classification Search ..... 175/5, 175/7; 166/352, 357, 358, 65.1
See application file for complete search history.

(56) References Cited

U.S. PATENT DOCUMENTS 3,621,911 A * 11/1971 Baker et al. ..... 166/336
4,063,602 A * 12/1977 Howell et al. ..... 175/7
4,120,362 A * 10/1978 Chateau et al. ..... 166/339

FOREIGN PATENT DOCUMENTS

GB 2194980 * 3/1988
GB 2202256 * 9/1988
GB 2334275 A 8/1999
GB 2334284 A 8/1999
GB 2337282 A 11/1999

* cited by examiner

*Primary Examiner*—Sunil Singh
(74) *Attorney, Agent, or Firm*—Bracewell & Giuliani LLP

(57) ABSTRACT

A power supply assembly, which is placed subsea and is connected to an umbilical from a platform, supplies electrical power to subsea equipment. The power supply assembly supplies power during drilling operations to a pump for pumping drilling fluid from the sea floor to the sea surface. During production operations, the power supply assembly provides power to a booster pump to pump the well fluid away from the subsea well for collection. The subsea power supply assembly optionally also provides power to electrically charged portions of subsea separators that remove water from the oil in the well fluid. The booster pump the pumps the oil from the separator away from the subsea wellhead for collection.

15 Claims, 5 Drawing Sheets

Fig. 1
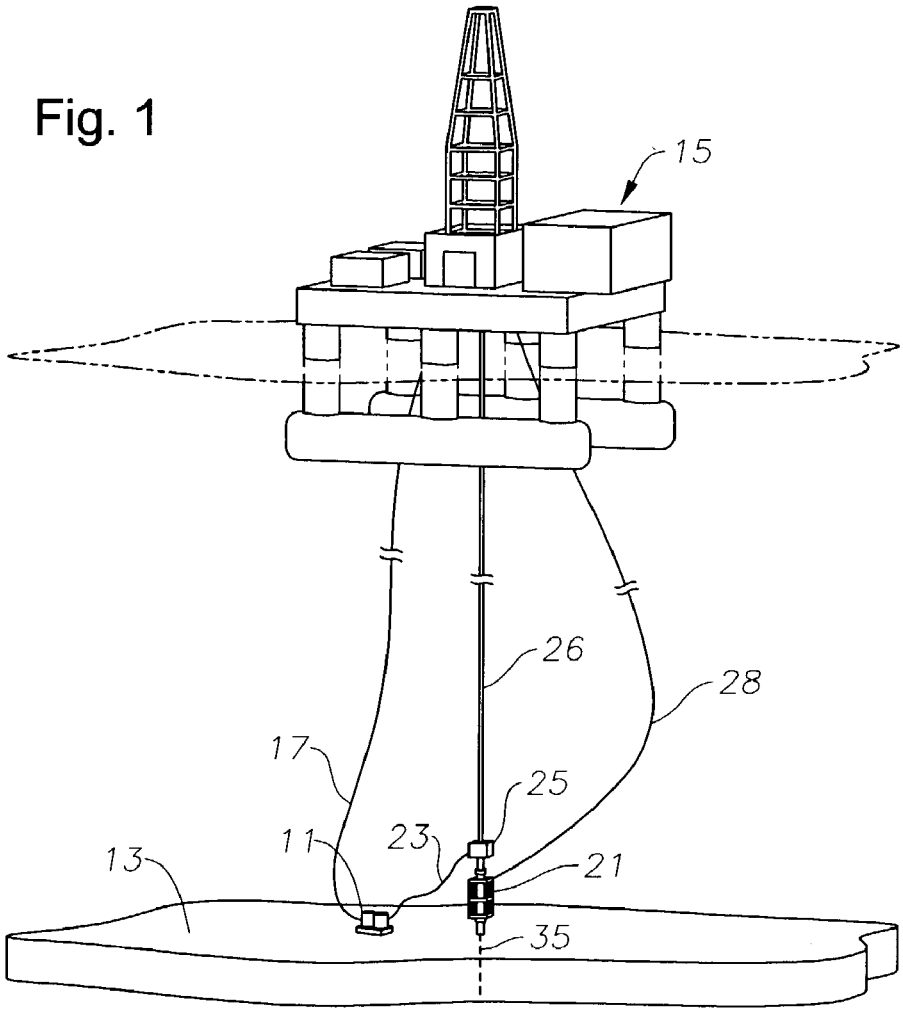
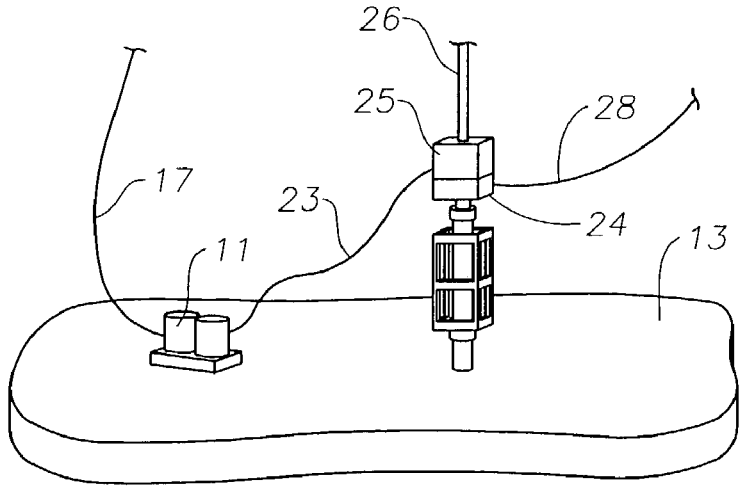
Fig. 2

Fig. 10
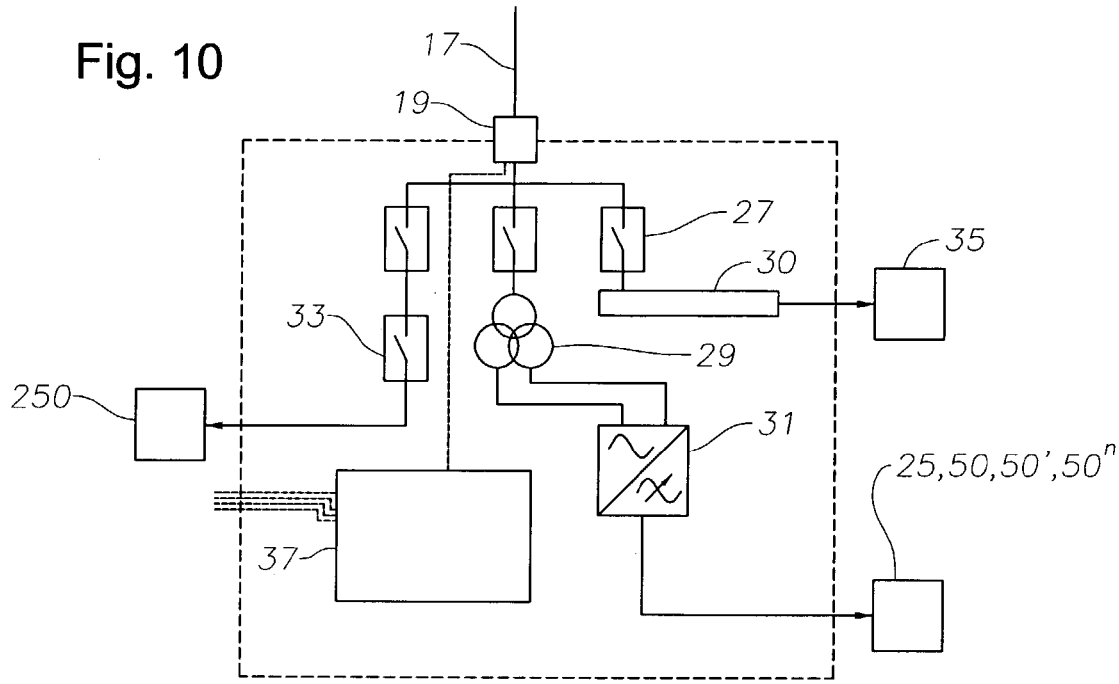
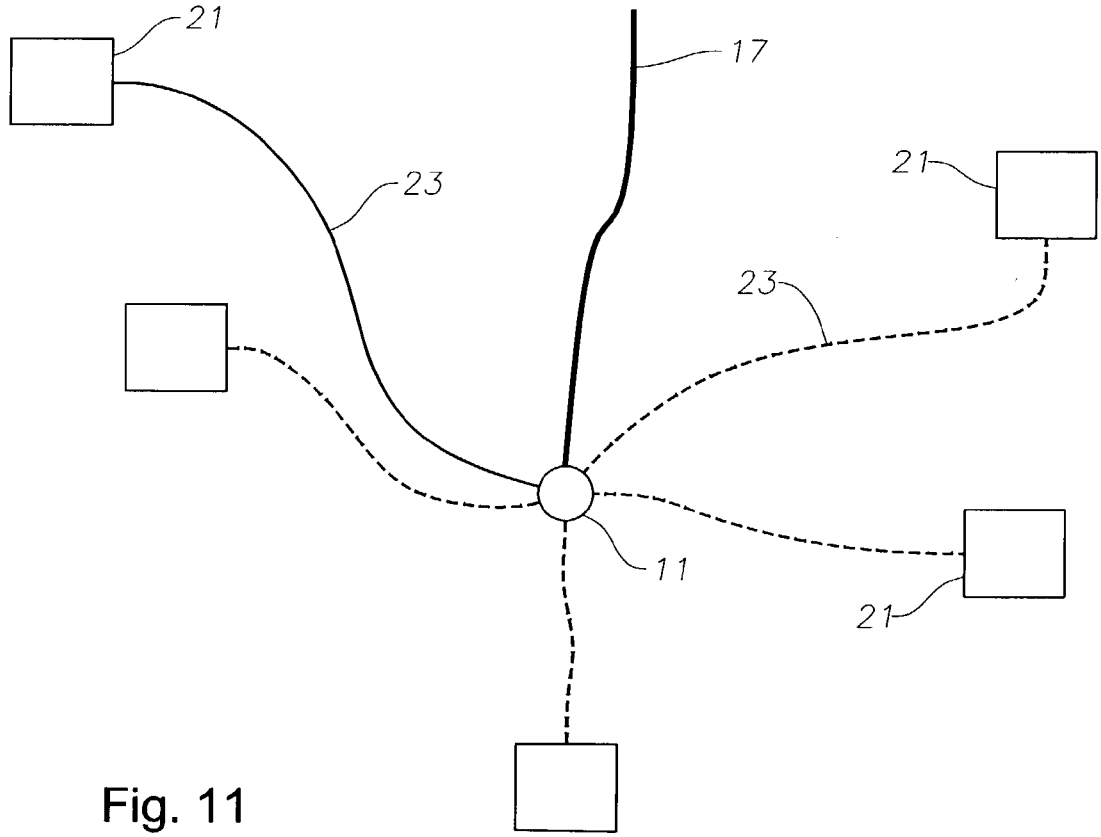
Fig. 11

INTEGRATED SUBSEA POWER PACK FOR DRILLING AND PRODUCTION

RELATED APPLICATIONS

Applicant claims priority to the application described herein through a United States provisional patent application titled "Integrated Subsea Power Pack for Drilling and Production," having U.S. Patent Application Ser. No. 60/356,024, which was filed on Feb. 11, 2002, and which is incorporated herein by reference in its entirety.

BACKGROUND OF INVENTION

1. Field of the Invention

The invention relates generally to supply of electrical power to pumps and other electrical equipment during drilling and production operations.

2. Background of the Invention

Electrical power is necessary for operating various devices and equipment associated with a subsea well during drilling operations. For example, sensors are typically placed at the wellhead so that operators can monitor the pressures and temperatures. If dual gradient drilling is employed, a subsea pump may be utilized to pump drilling fluid from the well and fluids to the surface. Typically, these devices require different voltages and may require different types of current (e.g., direct current or alternating current). Therefore, during drilling operations dedicated power lines are supply power to these pieces of subsea equipment from the surface. After drilling operations, the mud pump and sensors for drilling purposes are typically removed and other equipment is placed in or near the subsea well for production operations. Sometimes a drilling control pod is landed adjacent the subsea well being drilled, which can supply electrical power to some of the equipment.

Electrical power is also necessary for operating various devices and equipment associated with a subsea wellhead assembly during production operations. A downhole pump may be used. Also, a booster pump may be placed near the wellhead assembly for pumping well fluids (i.e., water and oil with some gas) to the surface or to a subsea collection facility which in turn pumps the well fluids to the surface. Operators also are developing systems placed subsea for processing the well fluids subsea, for the removal of water from the well fluids. Separating the oil from the water in the well fluids allows the operator to pump only the oil to the surface or the collection facility.

Sensors are typically placed at various locations of processing systems for monitoring quantities such as pressures, and flowrates. Like the sensors positioned in the well during drilling operations, sensors on the processing system will typically require a supply of electrical power. Additionally, the pumps for pumping the oil removed from the well fluid will also require a supply of electrical power. Separating the oil in a subsea separator system may be done with separators utilizing electricity to help separate water from the oil in the well fluid. Typically, the voltage and currents of the electrical power necessary for the sensors, separators, and pump in the processing equipment to operate are different. Therefore, in the past, a dedicated supply line must be provided to each of the devices from the surface.

SUMMARY OF THE INVENTION

A power supply or power supply assembly is located on the sea floor in close proximity to a wellhead of either subsea well. Typically, the well has not been drilled when the power supply is landed. The power supply is adapted to connect to an umbilical through which the power supply receives electricity from a platform or vessel above. During drilling operations, the power supply assembly connects to a motor to drive a subsea mud pump. A dual gradient mud pump on the drilling platform pumps the drilling mud through a string of drill pipe and out the drill bit that is drilling the subsea well. The subsea pump pumps the drilling fluids from the wellhead up a conduit to the platform. After drilling the well, the well is completed. The drill pipe is removed from the wellhead assembly, and a tree is typically landed on the wellhead.

Preferably, the power supply remains on the sea floor in close proximity to the wellhead assembly, now including the tree assembly. Electrically driven well production equipment is landed. The power supply connects to the electrically driven well production equipment. The power supply assembly receives electricity from the platform, through the umbilical, and then supplies power to the electrically driven production equipment. The electrically driven production equipment may include a booster pump which pumps well fluids from the wellhead assembly either to the platform or to a collection assembly for later retrieval. The production equipment can include a downhole pump. The production equipment can also include well fluid processing equipment for separating water and sand from the well fluids, thereby allowing the booster pump to pump only the oil from the separator to a surface facility. The processing equipment preferably includes a separator with portions or units that are electrically charged for separating water from the oil and gas in the well fluid. The power supply assembly provides the power and current/voltage frequency, to electrically charge the units in the separator for separating the water from the well fluid. The separators include an oil outlet in which the oil and gas exit the separator after the water and sand are removed from the well fluid. The remaining well fluid, the oil and gas after separation, is pumped by the booster pump either to the platform or to a collection assembly for later retrieval.

In situations where there are a plurality of wellhead assemblies in close proximity to each other, thereby forming a cluster of wells, the oil from each of the wells in the cluster is collected in a manifold. A booster pump may be used to pump the oil from the cluster to the platform or to the collection assembly for later retrieval.

The power supply assembly includes a waterproof housing so that the power assembly can be operated subsea. A connector connects the power assembly with an umbilical for receiving electrical power from the platform on the surface. The power supply assembly routes the electricity from the umbilical into three circuits. One circuit includes a transformer and variable speed drive for providing variable frequency power to subsea electrical equipment. Another circuit has a breaker that is selectively actuated to supply fixed frequency power to subsea electrical equipment. Another circuit provides low voltage, low power DC current to subsea electrical equipment. The three circuits are optionally connected to the subsea electrical equipment through a single flying lead extending from the power supply assembly or through multiple flying leads to each individual piece of subsea equipment. The power supply assembly optionally supplies electrical power at variable frequencies, to subsea electrical equipment during both drilling and production operations.

BRIEF DESCRIPTION OF THE DRAWINGS

FIG. 1 is a perspective view of a subsea platform floating above a subsea well and subsea power supply constructed in accordance with this invention.

FIG. 2 is a perspective view of the subsea well and subsea power supply shown in FIG. 1 during drilling operations.

FIG. 10 is a schematic view of the power supply shown in FIG. 1.

FIG. 11 is a schematic representation of the power supply and another arrangement of production equipment, positioned in proximity to a cluster of subsea wells.

DETAILED DESCRIPTION OF THE PREFERRED EMBODIMENTS

Figure 3:
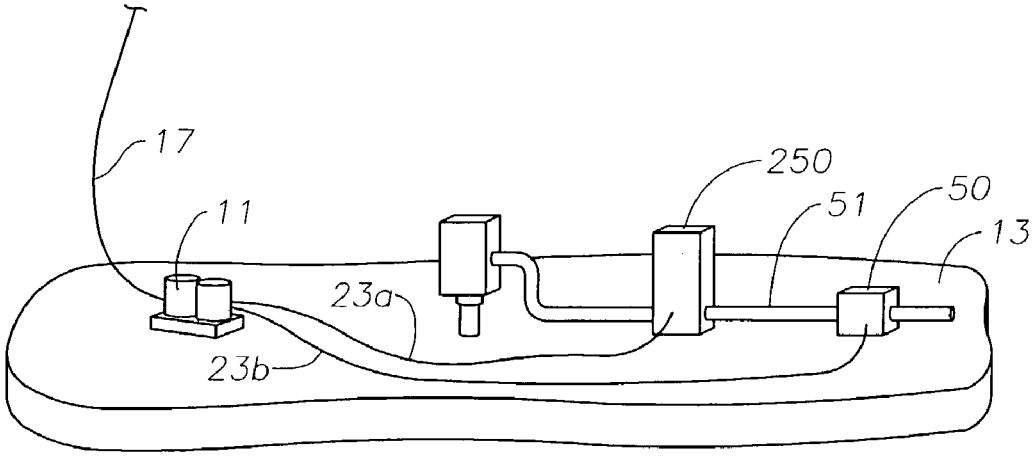
FIG. 3 is a perspective view of the power supply and subsea well shown in FIG. 1 after completion of the well and installation of production equipment.

Referring to FIG. 1, a subsea power supply assembly 11 is shown on a sea or ocean floor 13 below a floating platform 15. An umbilical 17 extends from platform 15 to subsea power supply assembly 11. Umbilical 17 communicates electrical current to subsea power supply assembly 11. Optionally, umbilical 17 can also have communication lines so that subsea power supply assembly 11 can communicate data from ocean floor 13 to platform 15 on the ocean surface. A connector 19 (FIG. 10) connects the end of umbilical extending below platform 15 to power supply assembly 11.

Power supply assembly 11 is placed on ocean floor 13 adjacent subsea wellhead assembly 21. Preferably, power supply assembly 11 is placed adjacent to subsea wellhead assembly 21 during drilling operations, which is shown in FIG. 1. Power supply assembly 11 supplies power to electrically driven equipment associated with drilling operations. A flying lead 23 extends from power supply assembly 11 toward subsea well 21. During drilling operations, flying lead 23 is typically connected to a motor 25 mounted to subsea wellhead assembly 21. In the preferred embodiment, motor 25 drives a pump, or mud pump 24 at the subsea wellhead 21 for returning drilling fluids to platform 15 during dual gradient drilling operations.

In FIG. 1, the well is shown being drilled without a riser. A string of drill pipe 26 having a drill bit at its lower end extends from vessel 15 through subsea wellhead assembly 21 and into the well. A mud pump on platform 15 pumps drilling mud down drill pipe 26, where it discharges at the bit. The drill fluid and cuttings return up the drill pipe annulus to a subsea mud pump 24 that is driven by motor 25. Subsea mud pump 24 pumps the drilling mud up a conduit or umbilical line 28 to platform 15. A rotary drilling head will be employed at the upper end of subsea wellhead assembly 21 to seal around drill pipe 26 where it enters subsea wellhead assembly 21. Umbilical line 28 also may include choke and kill conduits for controlling a blowout preventer and pipe rams.

Power supply assembly 11 may be removed after drilling, however, in the preferred embodiment, power supply assembly 11 remains adjacent sea floor 13 after completion of the subsea well through subsea wellhead assembly 21. Referring to FIG. 3, in the preferred embodiment, power supply assembly 11 selectively powers subsea production equipment that preferably includes a booster pump or well fluid pump 50, and processing equipment 250. In the preferred embodiment, processing equipment 250 preferably includes at least one separator 251 (FIG. 6) that has an electrically-charged coalescent unit 259 (FIG. 6) of each separator 251. In the preferred embodiment, well fluid pump 50 receives oil from processing equipment 250 after removal of water from the well fluids exiting subsea wellhead 21, and then pumps the oil and gas either to a vessel (not shown) for further processing or to a subsea collection assembly (not shown) where the oil is retrieved at a later time.

Figure 5:
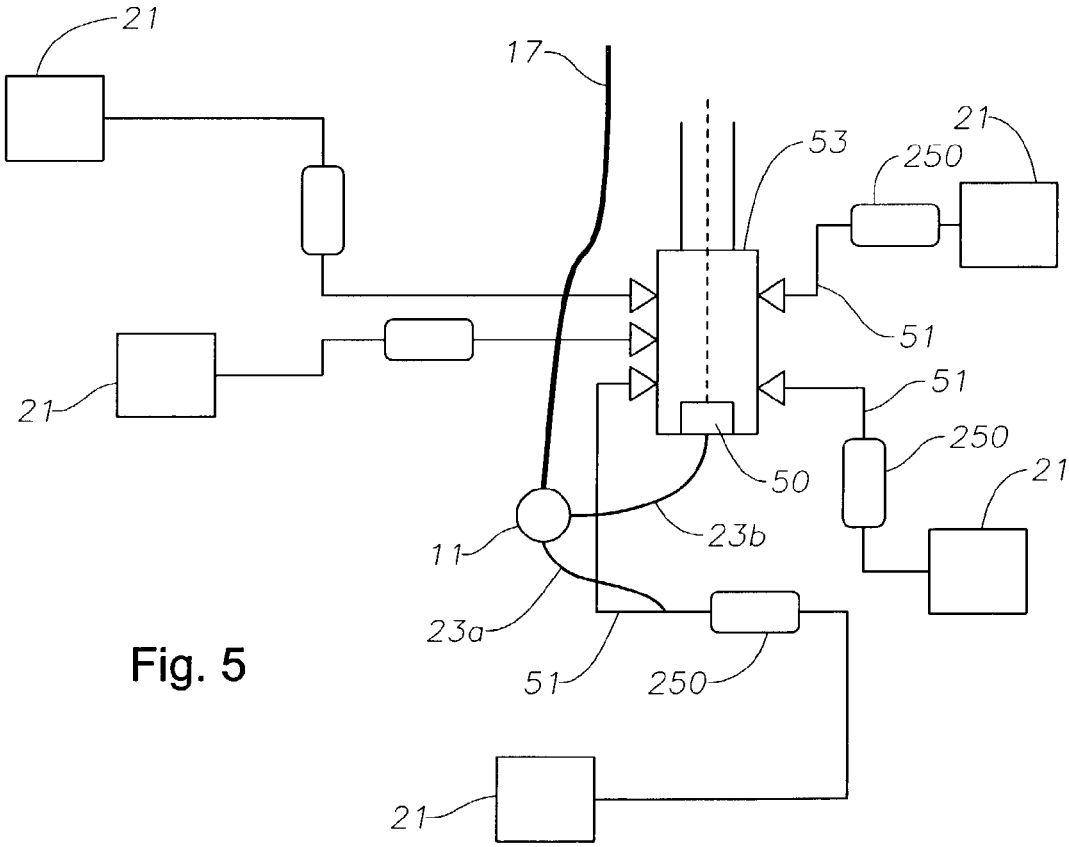
FIG. 5 is a schematic representation of the power supply and an arrangement of production equipment, including separators, positioned in proximity to a cluster of subsea wells during production operations.
Figure 6:
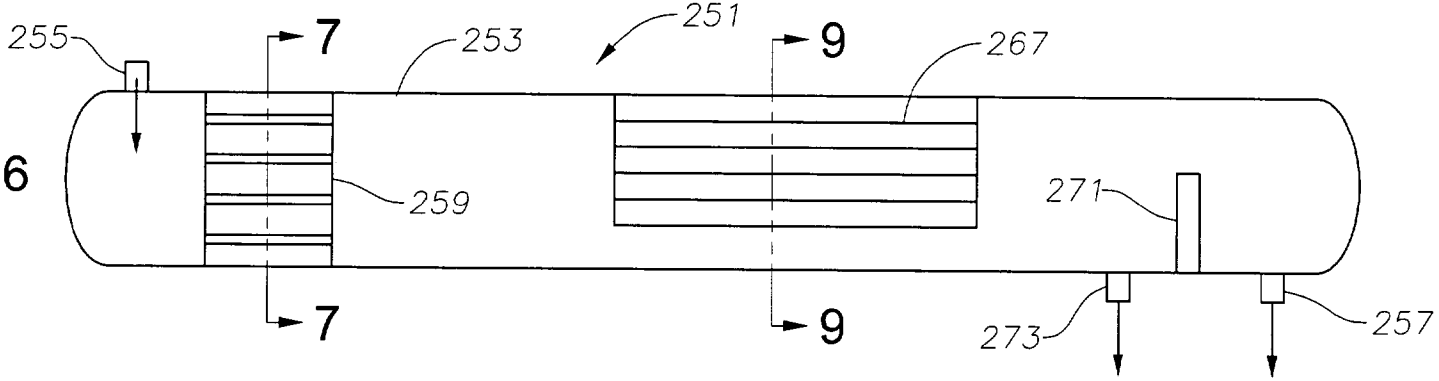
FIG. 6 is a cross-sectional view of the separator in FIG. 5.

Referring to FIG. 6, subsea processing systems or processing equipment 250 separates water and sand from the well fluid. The system includes a plurality of separators 251. A single separator 251 and well fluid pump 50 may be utilized with individual subsea well assemblies 21 as shown in FIG. 3, or more than one wellhead assembly 21 may feed into a single separator 251 feeding into a single pump 50. Additionally, in the preferred embodiment, when there is a cluster of subsea wellhead assemblies 21, as shown in FIG. 5 there may be plurality of separators 251 which all feed into pump 50. Separator 251, as shown in FIG. 3, comprises a horizontal vessel 253 that locates on the sea floor.

Figure 7:
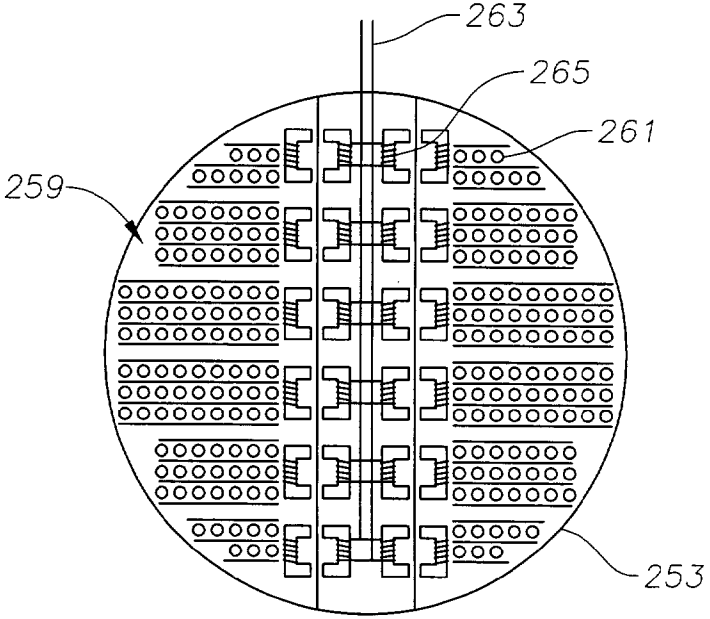
FIG. 7 is an enlarged schematic sectional view of a coalescent portion in the separator shown in FIG. 6 taken along line 7—7.

Separator 251 may be of various types for separating water and oil. In the preferred embodiment, separator 259 employs coalescent unit 259. Coalescent unit 259 has a plurality of passages 261 within it. FIG. 7 shows the large number of separate passages 261 located within vessel tube 253. An electrostatic field is applied to the oil and water mixture at the tubes or passages 261. By exposing the mixture of water and oil to an electrostatic field, the dipolar water droplets contained in the oil phase will be oriented in a way that makes them collide or coalesce with each other. This causes the water droplets to grow to bigger droplets. Generally, bigger droplets move and separate faster than smaller droplets. Consequently, a first separation from water and oil takes place in coalescent unit 259. This reduces the required retention time to get the water content out of the oil produced, allowing the separator vessel 253 diameter/size to be reduced.

As shown in FIG. 7, preferably low voltage supplied subsea is routed through low voltage wires 263 into the interior of separator vessel 253. A plurality of transformers 265 transform the low voltage to high voltage that is required for providing the electrostatic field. The same low voltage power supply is utilized for other functions, such as operating the solenoids and sensors involved with control of each subsea well 11.

Figure 8:
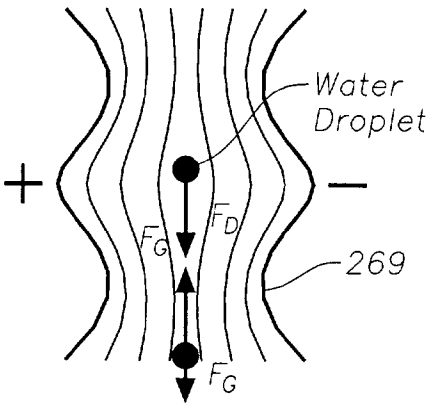
FIG. 8 is an enlarged schematic view of a dielectrophoresis separator portion of the separator of FIG. 7.
Figure 9:
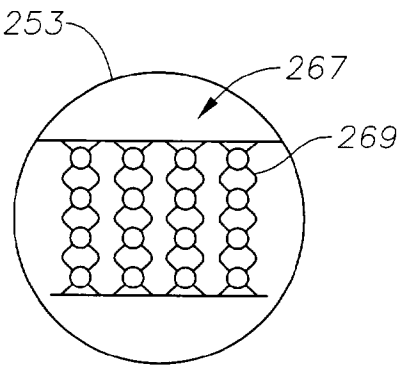
FIG. 9 is an enlarged schematic sectional view of a dielectrophoresis portion in the separator shown in FIG. 6 taken along line 9—9.

If coalescent unit 259 is not adequate to reach the desired water content, a second stage could be employed. A second stage could be another coalescent unit 259 or it could be a unit of a different type, such as dielectrophoresis unit 267. Unit 267 also uses an electrostatic field, however the field is configured to force the water droplets into designated sections of the separator and thereby form streams of water. Electrode sheets 269, as shown in FIGS. 8 and 9, have undulations. Electrode sheets 269 are closely spaced and arranged with the constrictive portions where two valleys are separated by the widened portions where two peaks are spaced across from each other. Sheets 269 force the water droplets to move towards the stronger section of the electrostatic field with stronger field gradients. The forces imposed by the gradient field are in the order of magnitude two to five times greater than the gravity force. This phenomenon is used to guide the water droplets into these predetermined sections, where they form continuous sections of water for use in separation. Dielectrophoresis unit 267 reduces the time normally needed for a conventional gravity separator.

Referring again to FIG. 6, a bulkhead 271 extends upward from separator vessel 253 near its downstream end. Bulkhead 271 divides a section for collecting higher water concentrations. A water outlet 273 is located upstream of bulkhead 271. Oil and water inlet 255 is located on an upper side of the upstream end of separator vessel 253. Oil outlet 257 is located on the downstream end of separator vessel 253 on the lower side. Typically, the oil exiting oil outlet 257 is saturated with natural gas. Referring to FIG. 3, a flow line 51 receives oil from processing equipment 250, preferably from oil outlet 257 (FIG. 6), and transports the oil either directly to pump 50, as shown in FIG. 3, or to a manifold 53 where well fluid pump 50 then pumps the oil to either vessel (not shown) or to a collection assembly (not shown).

Figure 4:
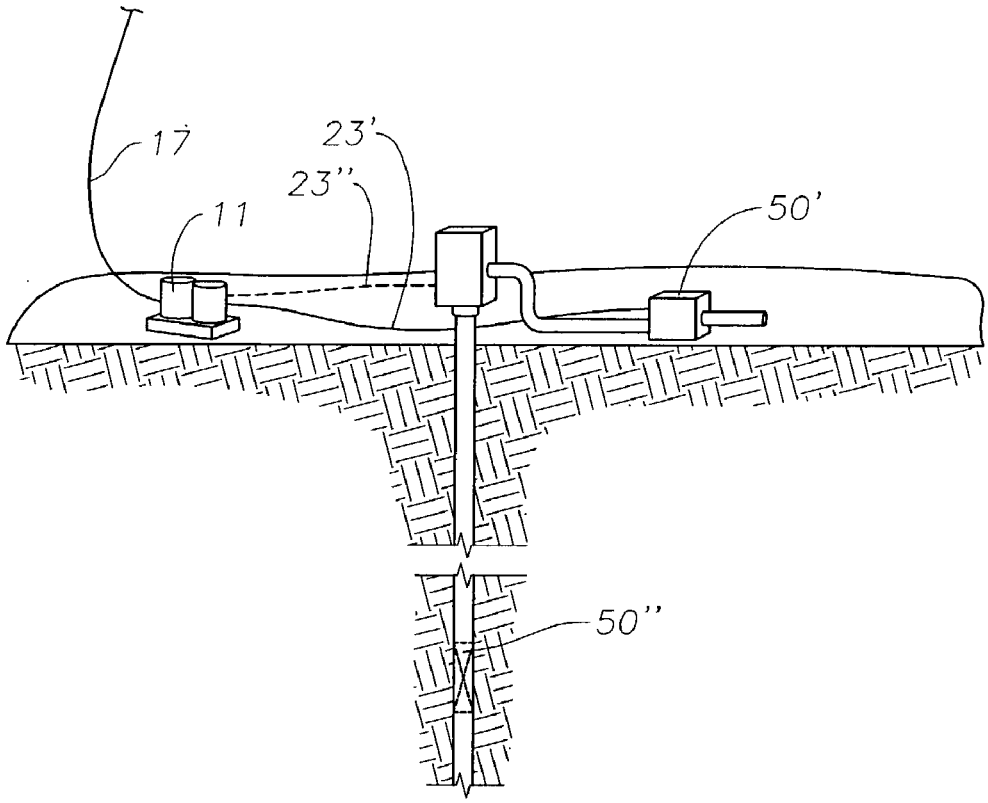
FIG. 4 is a perspective view of the power supply and subsea well shown in FIG. 3 after completion of the well and installation of another system of production equipment.

In an alternative embodiment, as shown in FIG. 4, well fluid pump is alternatively a subsea pump or booster pump 50' located adjacent sea floor 13, in close proximity to subsea wellhead assembly 21. Booster pump 50' receives well fluid from subsea wellhead assembly 21 and either pumps the well fluid to platform 15 or to a subsea collection assembly (not shown) for later retrieval. In this alternative embodiment, flying lead 23' supplies power to subsea pump 50' from power supply 11. In another alternative embodiment, as depicted by a dotted representation in FIG. 4, well fluid pump can be an electric submersible pump (ESP) 50" located downhole. ESP 50" is useful when the well does not have enough natural lift or pressure. In this alternative embodiment, flying lead 23" supplies power to subsea pump 50" from power supply 11. In these alternative embodiments, subsea power supply assembly 11 selectively provides the power to drive a well fluid pump whether it is either the ESP 50" located downhole or the subsea pump 50' adjacent sea floor 13.

Referring to FIG. 10, umbilical 17 and connector 19 connect platform 15 (FIG. 1) to power supply assembly 11 for the transfer of electricity from platform 15 to power supply assembly 11. In the preferred embodiment, connector 19 is a high voltage wet mateable connector to insure the safe transfer of high voltages of electricity underwater. At least one protective circuit breaker 27 is located inside of power supply assembly 11. In the preferred embodiment, circuit breaker 27 is the first circuit in power supply assembly 11 that the current of electricity from umbilical 17 must pass through. In the preferred embodiment, there are three circuit breakers 27 connected to the current of electricity from umbilical 17 operating parallel to one another. Preferably the electrical power delivered is three-phase alternating current.

A transformer 29 and a frequency converter or variable speed drive 31 are in series after one of circuit breakers 27. In the preferred embodiment, transformer 29 is a three-phase transformer. Transformer 29 and variable speed drive 31 communicate three-phase frequency electricity to motor 25 during drilling. Variable speed drive 31 may be of conventional design to control the frequency of the electricity sent to various electrical equipment. For example, motor 25 is optionally a variable speed motor. The speed of motor 25 changes with the frequency of electricity supplied. Typically, the circuit having transformer 29 and variable speed drive 31 supplies power to electrical equipment requiring high voltage and high power. In the preferred embodiment, during production, transformer 29 and variable speed drive 31 provide power to drive well fluid pump 50, 50', 50". As mentioned before, the well fluid pump may also be a subsea pump 50 as shown in FIGS. 3 and 5 for pumping oil that was separated from the well fluid in processing equipment 250. During production, transformer 29 and variable speed drive 31 alternatively provide power to drive either ESP 50" (as represented by dotted lines in FIG. 4) or subsea booster pump 50' (FIG. 4) adjacent sea floor 13.

In the preferred embodiment, another circuit breaker 33 is located after another of the three protective circuit breakers 27. Circuit breaker 33 can be toggled or actuated by the operator so that an electrical current selectively flows through breaker 33. The current flowing through breaker 33 is not altered, thus will be at the same frequency and voltage as being supplied from platform 15. The circuit having breaker 33 may be used for supplying power to a fixed speed motor, or any other electrical equipment that does not require variable frequency power. This equipment could comprise solenoids (not shown) for opening and closing valves (not shown) within processing equipment 250.

In the preferred embodiment, there is final protective circuit breaker 27 leading to a circuit 30 that supplies a low voltage and/or low power electrical current, preferably DC current, to electrical equipment. Typically, a sensor 35 is supplied electricity from this circuit. Sensors 35 are placed at various locations throughout the well production assembly to measure pressure, temperature, and flow rates. Also coalescent unit 259 (FIG. 6) and dielectrophoresis unit 267 (FIG. 6), are electrically charged with DC current in order to create a sufficient electrostatic field for water separation, as described above. Circuit 30 is of conventional design, typically having a transformer and rectifier.

Typically flying lead 23 connects power supply assembly 11 to the main electricity consumer. In the preferred embodiment, the main consumer of electrical equipment typically receives the higher power and higher voltage from the circuit having transformer 29 and variable speed drive 31. Typically, motor 25 is the main consumer during drilling operations. Flying lead 23 communicates the power from all the circuits in power supply assembly 11 to the various consumers through separate power cables for each circuit in power supply assembly 11. Lines lead from circuit breaker 33 to fixed speed electrical devices, and from low power supply circuit 30 to sensors 35. As shown in FIG. 3, there may also be a pair of flying leads 23*a*, 23*b* connecting power supply 11 to different electrical consumers. For example, in FIG. 3, flying lead 23*a* extends from power supply 11 to processing equipment 250 and flying lead 23*b* extends from power supply 11 to well fluid pump 50. Well fluid pump 50 is the main electrical consumer in FIG. 3, therefore flying lead 23*b* connects pump 50 to the variable speed drive 31.

Flying lead 23 may also contain wires for sensors 35 to send data collected regarding well 21 to power supply assembly 11. A control hub 37 is preferably located inside power supply assembly 11. Control hub 37 receives data collected from sensors 35 regarding various conditions of well 21 (e.g. pressure, temperature, flow rates) during drilling and production operations. Control hub 37 also transmits the data received from sensors 35 through umbilical 17 for monitoring and control on platform 15. Having control hub 37 in power supply assembly 11 allows power and data transmissions to flow through multifunctional umbilical 17 rather than one umbilical for power and one umbilical for data transmissions and controls. Optionally, control hub 37 also connects to variable speed drive 31, and to breakers 33 and 27 to control the electrical currents flowing out of power supply assembly 11 to electrical equipment associated with well 21.

In operation, power supply assembly 11 is placed adjacent to subsea wellhead assembly 21 before or during early stages of drilling. In situations where there are a plurality of wellhead assemblies 21 situated in a cluster on sea floor 13, as shown in FIGS. 5 and 11, power supply 11 is placed adjacent the sea floor 13 in a location that flying lead 23 can connect to each wellhead assembly 21 during drilling operations and any processing equipment 250 during production operations. Umbilical 17 extends down from platform 15 (FIG. 1) and connector 19 connects umbilical 17 to power supply assembly 11. Sensors 35 are placed at various locations on well 21. A mud pump 24 and motor 25 are landed on top of wellhead assembly 21 along with a BOP. Wiring for power supply and data transmissions is run from sensors 35 to motor 25. Flying lead 23 is extended from power supply assembly 11 to motor 25. Flying lead 23 has data communication lines for data transmitted from the sensors to communicate to control hub 37 in power supply assembly 11. Flying lead 23 connects variable speed drive 31 to motor 25. Flying lead 23 also connects low power circuit 30 to the wiring at motor 25 from sensors 35 so that power can communicate to sensors 35. Flying lead 23 also has a power line connecting the circuit having breaker 33 to motor 25. During drilling operations, breaker 33 is typically open so that no power flows through this circuit. Normally, during drilling, hydraulic power for any valves at well 21 is supplied from platform 15. Consequently, fixed speed power may not be needed during drilling. The operator receives data transmitted from control hub 37 through umbilical 17 and transmits signals to control hub 37 to speed up or slow down the mud pump with variable speed motor 25. The operator uses variable speed drive 31 to control variable speed motor 25 through control hub 37 in order to vary the speed of motor 25.

After drilling operations are complete, power supply assembly 11 can remain adjacent to well 21 to supply power for production equipment, or power supply assembly 11 can be transported to another well 21 to drilling operations. Optionally, if power supply assembly 11 is located adjacent to a cluster of wells 21, flying lead 23 can be maneuvered so that power supply assembly 11 supplies power to electrical equipment performing operations on another well 21 in the cluster.

During production, power supply assembly 11 supplies power to equipment used to drive the production equipment. In the preferred embodiment, as shown in FIG. 3, power supply 11 is located in adjacent sea floor 13, in close proximity to processing equipment 250 and well fluid pump 50. Additionally, where there is a cluster of wellhead assemblies 21 on sea floor 13, as shown in FIG. 5, preferably power supply 11 powers production equipment 250 associated with each wellhead assembly 21. In the preferred embodiment, power supply 11 connects to processing equipment 250 for each wellhead assembly and well fluid pump 50 located at manifold 53. The separated oil is then pumped from manifold 53 by pump 50 to a vessel (not shown) or to a collection assembly (not shown) for later retrieval. Referring to FIG. 4, in the alternative embodiments, flying lead 23 may connect to a juncture at the upper end of wellhead assembly 21 for powering downhole ESP 50", or flying lead 23 can connect directly to subsea booster pump 50' adjacent sea floor 13.

Referring to FIG. 10, the power lines from low power circuit 30 and from the juncture to their respective equipment such as sensors 35. In either of the embodiments, sensors 35 may optionally remain throughout well 21. Therefore, control hub 37 optionally may be used by operator to transmit data of well 21 operating conditions to platform 15. Breaker 33 may be closed so that power flows though flying lead 23 to main electrical consumers such as a fixed speed motor (not shown) driving a pump used to supply hydraulic fluid pressure to hydraulically actuated valves in well 21. In the preferred embodiment, transformer 29 and variable speed drive 31 provide power to well fluid pump 50 (FIGS. 3, 5) for pumping oil after processing, and fixed frequency power from breaker 33 electrically charges units 259, 267 in separator 251.

During work over operations, flying lead 23 may extend to a motor driving pumps used to maintain downhole pressure, such as in a string of coil tubing in well 21. Alternatively, the pump may also be used for fracing or chemical injection during work-over of well 21. Flying lead 23 typically contains the same power lines from the different circuits and the same communication lines from control hub 37; however, as shown in FIGS. 3, 5, two flying leads 23*a*, 23*b* preferably extend from power supply 11 when processing equipment 250 and well fluid pump 50 are powered by power supply 11. Typically, during a workover, hydraulically operated valves are supplied with hydraulic pressure directly from platform 15. Therefore, breaker 33 may be open during work over operations. Sensors 35 may optionally be used to monitor well 21 conditions during work over operations. As shown in FIG. 1, flying lead 23 optionally supplies power to data from sensors 35 from low power circuit 30 in power supply assembly 11.

Further, it will also be apparent to those skilled in the art that modifications, changes and substitutions may be made to the invention in the foregoing disclosure. Accordingly, it is appropriate that the appended claims be construed broadly and in the manner consisting with the spirit and scope of the invention herein. For example, during work over of subsea well 21, a motor may receive power from variable speed drive 31 for driving the pumps for maintaining downhole pressure through coil tubing.

What is claimed is:

1. A method for drilling and producing a well, comprising the steps:

(a) providing a subsea wellhead assembly at a sea floor;

(b) locating an electrical power supply assembly subsea adjacent the sea floor and connecting the power supply to an umbilical from a platform at the surface;

(c) extending a string of drill pipe and a drill bit through the sub sea wellhead assembly, and drilling a well with the drill bit while pumping drilling fluid from the platform through the drill pipe, which returns back up to the wellhead assembly;

(d) connecting a pump to the wellhead assembly in communication with the drilling fluid returning back up the well, and to a conduit leading to the platform;

(e) supplying electricity from the power supply to the pump, and pumping the drilling fluid up the conduit to the platform;

(f) completing the well and installing production equipment subsea; and then, (g) after completion of the well, supplying electricity from the power supply assembly during production operations to subsea production equipment.

2. The method for supplying power according to claim 1, further comprising the steps, before step (e):

providing a variable speed drive in the power supply assembly; and then with the variable speed drive, varying the frequency of the electricity supplied to the pump in step (e).

3. The method for supplying power according to claim 1, wherein:

step (f) comprises the step of installing an electric submersible pump in the well; and wherein at least some of the power supplied in step (g) powers the electric submersible pump to pump well fluids out of the well.

4. The method for supplying power according to claim 3, further comprising the steps, before step (g):

providing a variable speed drive in the power supply assembly; and then with the variable speed drive, varying the frequency of the electricity supplied to the electric submersible pump in step (g).

5. The method for supplying power according to claim 1, wherein:

step (f) comprises the step of installing a booster pump adjacent the sea floor; and wherein at least some of the power supplied in step (g) powers the booster pump to pump well fluids away from the subsea wellhead assembly.

6. The method for supplying power according to claim 1, wherein:

step (f) comprises the step of installing a separator for removing water from the production fluid, the separator having an electrically charged unit; and wherein the power supplied in step (g) supplying power to the electrically charged unit.

7. A method for drilling and producing a well, comprising the steps:

(a) providing a subsea wellhead assembly at a sea floor;

(b) locating an electrical power supply assembly subsea adjacent the sea floor and connecting the power supply to an umbilical from a platform at the surface;

(c) extending a string of drill pipe and a drill bit through the subsea wellhead assembly, and drilling a well with the drill bit while pumping drilling fluid from the platform through the drill pipe, which returns back up to the wellhead assembly;

(d) connecting a pump to the wellhead assembly in communication with the drilling fluid returning back up the well, and to a conduit leading to the platform;

(e) supplying electricity from the power supply to the pump, and pumping the drilling fluid up the conduit to the platform;

(f) completing the well and installing a coalescent separator for receiving production fluid from the wellhead assembly; and then, (g) after completion of the well, supplying electricity from the power supply assembly during production operations to the coalescent separator; and then (h) flowing well fluid produced from the well into to the coalescent separator.

8. The method for supplying power according to claim 7, further comprising the steps:

(i) installing a well fluid pump downhole in the well completed in step (f);

(j) supplying electricity from the power supply to operate the well fluid pump; and (k) pumping well fluid with the well fluid pump out of the well.

9. The method for supplying power according to claim 7, further comprising the steps:

(i) installing a well fluid pump adjacent the sea floor;

(j) supplying electricity from the power supply to operate the well fluid pump; and (k) pumping well fluid with the well fluid pump away from the wellhead assembly.

10. The method for supplying power according to claim 7, wherein the coalescent separator includes electrically charged portions for separating water from oil in the well fluid; and further comprising the step:

separating the water from the oil in the well fluid.

11. Well drilling and production equipment for a subsea well, comprising:

a subsea power supply located subsea adjacent a sea floor that is adapted to be connected to a surface platform by an umbilical for receiving power; and a drilling fluid pump located subsea that is electrically powered by the power supply for pumping drilling fluid to the platform while the well is being drilled; and a coalescent separator located subsea that is powered by the power supply after the well has been completed for producing the well, the coalescent separator comprises an electrically-charged unit which receives well fluid and separates water from the well fluid before the well fluid is pumped from the well.

12. The well drilling and production equipment according to claim 11, wherein the subsea power supply further comprises:

a first circuit having a variable frequency drive for varying the frequency of the electrical power supplied to the drilling fluid pump during drilling operations.

13. The well drilling and production equipment according to claim 11, further comprising a downhole electrical submersible pump that is powered by the power supply after the well has been completed for producing the well.

14. The well drilling and production equipment according to claim 11, further comprising a subsea booster pump for pumping well fluids to a collection facility that is powered by the power supply after the well has been completed for producing the well.

15. Well drilling and production equipment according to claim 11, wherein the power supply has circuits that produce variable frequency power, fixed frequency power, and DC power.

* * * * *